US005605002A

United States Patent [19]

Carey

[11] Patent Number: 5,605,002

[45] Date of Patent: Feb. 25, 1997

[54] FIREARM BREECH BLOCK ACTUATOR

[76] Inventor: Donald C. Carey, 11430 Payette Hts. Rd., Payette, Id. 83661

[21] Appl. No.: 550,107

[22] Filed: Oct. 30, 1995

[51] Int. Cl.[6] ..... F41A 3/00; F41C 27/00

[52] U.S. Cl. ..... 42/17; 42/106; 89/181

[58] Field of Search ..... 42/17, 21, 90, 42/106; 89/181, 187.01

[56] References Cited

U.S. PATENT DOCUMENTS

| | | | |
|---|---|---|---|
| 659,507 | 10/1900 | Browning . | |
| 1,047,337 | 12/1912 | Toborg | 42/21 |
| 2,090,340 | 8/1937 | Browning | 42/4 |
| 2,418,946 | 5/1947 | Loomis | 42/4 |
| 2,510,685 | 6/1950 | Chevallier et al. | 42/1 |

*Primary Examiner*—J. Woodrow Eldred
*Assistant Examiner*—Theresa M. Wesson
*Attorney, Agent, or Firm*—Eugene D. Farley

[57] ABSTRACT

A firearm breech block actuator for operating the latch of a spring-pressed, latch-controlled firearm breech block having a push button latch control positioned for pressing by the fingers of the marksman preliminary to firing the firearm. The actuator comprises an arm overlying the push button in bearing engagement therewith and having an outer surface sufficiently large to accommodate a plurality of the marksman's fingers. The arm is mounted on the firearm for reciprocating movement toward and away from the push button. This operates the breech block latch. The actuator preferably is constructed of an integral piece of resilient plastic or metal attached by screws to the receiver of the firearm.

9 Claims, 1 Drawing Sheet

FIREARM BREECH BLOCK ACTUATOR

FIELD OF THE INVENTION

This invention relates to firearm breech block actuators. It relates particularly to the breech block actuators of automatic and semi-automatic shotguns.

BACKGROUND OF THE INVENTION

The conventional automatic or semi-automatic shotgun comprises a barrel, a cartridge chamber, a forestock (forend with forend cover), a butt stock and a receiver. The receiver houses the gun breech in which a spring-pressed breech block reciprocates between a retracted loading position and an advanced battery position. The breech block is biased in the direction of the battery position. A latch maintains the breech block open in its loading position.

The latch is controlled by a push button which extends outwardly from a side face of the receiver housing. It is operable by a finger of the marksman as he holds the gun in shooting position. In single shot or multiple shot procedures the sequence of operations to prepare to fire the gun is as follows:

First, with the breech open, a cartridge is placed in the chamber through the loading port. If two or more shots are to be fired, cartridges are placed in the cartridge magazine.

The cartridge latch is operated by depressing the push button using a finger or the thumb. This in turn releases tha spring-pressed breech latch so that the breech block moves forwardly under spring pressure into battery position. The gun now is ready to fire.

The push button which operates the latch is characterized by appreciable resistance to movement. In cold weather, when the marksman's fingers are numb, it is difficult to operate. In competitive clay pigeon shooting, when five or six hundred rounds a day may be fired by a single marksman, the finger which operates the push button becomes tired and sore.

It is the general purpose of the present invention to provide a firearm appliance which overcomes the foregoing problem and which makes it easy for the marksman to fire his gun any number of times without any discomfort whatsoever resulting from depression of the push button breech block latch control.

It is a further object of the invention to provide such an appliance which is simple, inexpensive, and applicable for use with a large number of the firearm models available on the market today without modification of either the firearm or the appliance.

BRIEF DESCRIPTION OF THE INVENTION

The firearm breech block actuator of my invention which provides a solution to the foregoing problem broadly comprises an arm overlying the push button latch actuator of the firearm in bearing engagement therewith. The arm has an outer surface sufficiently large to accommodate a plurality of the marksman's fingers, for example three or four.

Mounting means mount the arm on the firearm for reciprocating movement toward and away from the receiver side face. This motion operates the push button which, in turn, operates the breech block latch.

In its simplest form, the actuator comprises simply an angular piece of resilient structural material having an arm segment and a mounting segment, with attaching means for attaching the mounting segment to the firearm. The attaching means preferably comprises one of the screws by means of which the forend cover is attached to the receiver.

DESCRIPTION OF A PREFERRED EMBODIMENT OF THE INVENTION

Figures 1, 2, 3, 4:
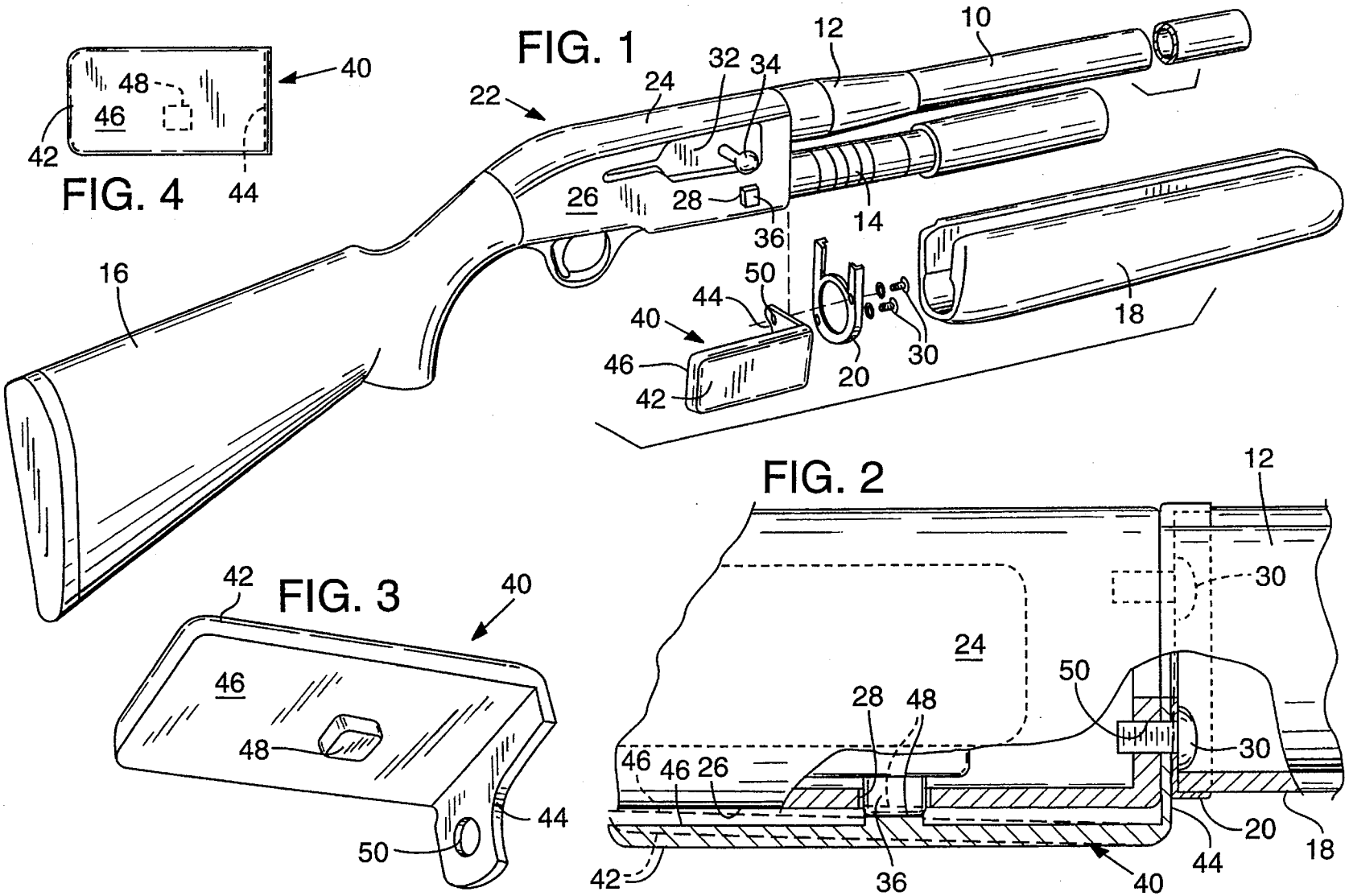
FIG. 1 is an exploded view in perspective of a semi-automatic shotgun and the herein described breech block actuator, illustrating the manner of attachment of the actuator to the gun.
FIG. 2 is a fragmentary view in elevation, partly in section, of the assembled receiver and forend sections of the gun, further illustrating the manner in which the herein described breech block actuator is mounted on the gun, and its manner of operation.
FIG. 3 is a view in perspective of the actuator per se.
FIG. 4 is a view in elevation of the actuator per se.

FIG. 1 illustrates the application of the firearm breech block actuator of my invention to a semi-automatic shotgun.

The shotgun broadly comprises a gun barrel 10, a cartridge chamber 12, a magazine 14, a butt stock 16 and a forestock or forend 18 equipped with a forend cover 20.

The receiver section 22 of the gun is contained in a housing 24 having a side face 26. An opening 28 in the side face communicates with the interior of the receiver. Bolts 30 are threaded into the foreward end wall of receiver housing 24 and secure forend cover 20 thereto.

Receiver housing 24 encloses a spring-pressed, latch-operated breech block 32 with operating extension 34. The breech block reciprocates between retracted and advanced positions as required to open and close the breech in the usual manner. A latch, not illustrated, retains the breech block in its retracted position for loading the gun. The spring is biased in the direction of breech block closure. It is operative to return the breech block to its closed position when released by the latch.

Latch release is effectuated before each shot is fired by pushing an associated push button 36 with one of the marksman's fingers.

All of the above is conventional structure, the gun illustrated in the drawings incompletely and somewhat schematically being a Beretta U.S.A. Model 300–303 (1989).

As noted above, push button 36 often is stiff and hard to operate, since it accommodates but a single finger. This is particularly true in cold and/or rainy weather the marksman's finger becomes tired and sore after a multiplicity of rounds have been fired.

The present invention overcomes this problem by making use of the breech block actuator illustrated in detail in FIGS. 3 and 4. The actuator provides a means of depressing push button 36 using the strength of a multiplicity of fingers, preferably with a leveraged action. This makes it possible to shoot the firearm indefinitely without fatiguing or causing pain to the fingers concerned.

In its broad concept the actuator comprises an arm overlying push button 36 in bearing engagement therewith. The arm has an outer surface sufficiently large to accommodate a plurality of the marksman's fingers.

Mounting means mount the arm on the gun for reciprocating movement toward and away from the side face 26 of receiver 22 thereby alternately depressing and releasing the push button and working the breech block latch mechanism.

In the illustrated specific and preferred embodiment, the breech block actuator 40 comprises an angular piece of resilient structural material having an arm segment 42 and a mounting segment 44. The actuator may be of any suitable structural material of appropriate strength and resiliency, such as springy plastic or springy metal. It preferably is molded or fashioned integrally in one piece.

Arm segment 42 has an inner face 46 which overlies push button 36 in operative position. It has a centrally located contact pad 48 which extends inwardly in the direction of push button 36 in substantial registration and in bearing engagement therewith.

It is to be noted that arm 42 acts as a lever, springing back and forth angularly relative to mounting segment 44, and materially increasing the force which may be applied to push button 36 with minimum finger pressure.

It is a particular feature of the invention that actuator 40 may be applied to many of the shotgun models currently available particularly the currently available models of the Beretta shotgun, without any reconstruction or mutilation of the same at all. This result is achieved by using one of bolts 30, which mount forend cover 20 to receiver housing 26, as the means of mounting the actuator to the receiver. The manner in which this is accomplished is illustrated in detail in FIG. 2. This operation may be accomplished in a few minutes time and provides a stable mounting for the actuator, in precisely the correct position.

The manner of operation of the herein described actuator is particularly apparent from FIG. 2.

When it is desired to actuate push button 36, the marksman places at least two of his fingers, normally all four, on actuator arm segment 42. Thereafter with a minimum of effort, assisted particularly by the lever action of arm segment 42, he can depress the push button and release the breech block latch thereby shifting the breech block 32 to its advanced position. This routine can be repeated as many times as desired during a single shooting session without causing pain or fatigue.

Having thus described in detail a preferred embodiment of the present invention, it will be apparent to those skilled in the art that many physical changes may be made without altering the inventive concepts and principles embodied therein. The present embodiment is therefore to be considered in all respects as illustrative and not restrictive, the scope of the invention being indicated by the appended claims.

I claim:

1. In a firearm comprising a receiver housing a latch-controlled breech block and having a side face positioned for pressing engagement by the fingers of the marksman, and a latch-operating push button extending outwardly from the side face, the improvement comprising:

a) an arm overlying the push button in bearing engagement therewith and having an outer surface sufficiently large to accommodate a plurality of a marksman's fingers, and b) mounting means for mounting the arm on the firearm for reciprocating movement toward and away from the said side face, thereby operating the breech block latch.

2. The breech block actuator of claim 1 wherein the arm has an inside face and on its inside face a contact button positioned for registration and contact with the push button for a more positive operation of the same.

3. The breech block actuator of claim 1 wherein the arm is a lever arm and the push button is positioned to act as a fulcrum.

4. The breech block actuator of claim 1 wherein the arm and the mounting means therefor comprise an angular integral piece of resilient structural material having an arm segment and a mounting means segment, and attaching means for attaching the mounting means segment to the firearm.

5. The breech block actuator of claim 4 wherein the structural material comprises resilient plastic.

6. The breech block actuator of claim 4 wherein the structural material comprises resilient metal.

7. The breech block actuator of claim 4 wherein the attaching means comprises screw means.

8. The breech block actuator of claim 4 wherein the firearm has a forend component and a forend cover component attached to the receiver by means of at least one screw, and wherein the attaching means comprises said screw.

9. In a firearm comprising a receiver housing a latch-controlled breech block and having a side face positioned for pressing engagement by the fingers of the marksman, and a latch-operating push button extending outwardly from the side face, the combination with the receiver of:

a) an arm overlying the push button in bearing engagement therewith and having an outer surface sufficiently large to accommodate a plurality of a marksman's fingers, and b) mounting means for mounting the arm on the firearm for reciprocating movement toward and away from the said side face, thereby operating the breech block latch.

* * * * *